US006559111B2

(12) United States Patent
Colurciello, Jr. et al.

(10) Patent No.: US 6,559,111 B2
(45) **Date of Patent: *May 6, 2003**

(54) ACIDIC HARD SURFACE CLEANING AND DISINFECTING COMPOSITIONS WHICH INCLUDE SILICONE QUARTERNARY AMMONIUM SALTS

(75) Inventors: Andrew Francis Colurciello, Jr., Newburgh, NY (US); Mark Timothy Bennett, West Milford, NJ (US)

(73) Assignee: Reckitt Benckiser, Inc., Wayne, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/361,908

(22) Filed: Jul. 27, 1999

(65) Prior Publication Data

US 2002/0002125 A1 Jan. 3, 2002

(30) Foreign Application Priority Data

Aug. 11, 1998 (GB) ..... 9817355

(51) Int. Cl.[7] ..... C11D 1/72; C11D 1/75; C11D 3/43

(52) U.S. Cl. ..... 510/238; 510/191; 510/199; 510/423; 510/433; 510/434; 510/466; 510/477; 510/488; 510/495; 510/503; 510/504; 510/505

(58) Field of Search ..... 510/191, 199, 510/238, 423, 433, 434, 466, 477, 488, 495, 503, 504, 505

(56) References Cited

U.S. PATENT DOCUMENTS

| | | | | | |
|---|---|---|---|---|---|
| 5,120,532 | A | * | 6/1992 | Wells et al. | 424/70 |
| 5,145,596 | A | * | 9/1992 | Blank et al. | 510/513 |
| 5,656,585 | A | * | 8/1997 | Grandmaire et al. | 510/524 |
| 5,885,951 | A | * | 3/1999 | Loder | 510/238 |
| 5,998,359 | A | * | 12/1999 | Littig et al. | 510/525 |
| 6,136,770 | A | * | 10/2000 | Cheung et al. | 510/384 |

FOREIGN PATENT DOCUMENTS

| | | | | |
|---|---|---|---|---|
| EP | 0 129 980 | * | 1/1985 | C11D/3/48 |
| WO | WO92/14810 | * | 9/1992 | C11D/3/16 |
| WO | WO97/36980 | * | 10/1997 | C11D/3/16 |

OTHER PUBLICATIONS

Copy of PCT International Search Report for PCT/GB99/02611 dated Oct. 28, 1999.*

* cited by examiner

*Primary Examiner*—Gregory Delcotto
(74) *Attorney, Agent, or Firm*—Fish & Richardson P.C.

(57) ABSTRACT

Acidic, hard surface cleaning and disinfecting compositions include a film-forming, organosilicone quaternary ammonium compound providing a protective layer for water and stain repellency

13 Claims, No Drawings

ACIDIC HARD SURFACE CLEANING AND DISINFECTING COMPOSITIONS WHICH INCLUDE SILICONE QUARTERNARY AMMONIUM SALTS

The invention relates to hard surface cleaning and disinfecting compositions providing a protective layer for water and stain repellency.

Cleaning compositions are commercially important products and enjoy a wide field of utility in assisting in the removal of dirt and grime from surfaces, especially those characterized as useful with "hard surfaces". Hard surfaces are those which are frequently encountered in lavatories such as toilets, shower stalls, bathtubs, bidets, sinks, etc., as well as countertops, walls, floors, etc. In such lavatory environment various forms of undesirable residues are known to form including hard water stains as well as "soap scum stains". Hard water stains are mineral stains caused by the deposition of salts, such as calcium or magnesium salts, frequently present in hard water. Soap scum stains are residues of fatty acid soaps such as those which are based on alkali salts of low fatty acids, which precipitate in hard water due to the presence of metal salts therein, leaving an undesirable residue upon such surfaces.

The prior art has suggested many compositions which are directed to the cleaning of such hard water and soap scum stains. ("Soap scum" is sometimes referred to as "limescale" in Europe.) Many of these are acidic, aqueous compositions which include one or more detersive surfactants. A limited number of these compositions, in addition to a detersive benefit, also provide a germicidal or sanitizing effect to the hard surfaces being treated. Many of these prior art compositions also suffer from the shortcoming in that they do not provide any significant long term cleaning or sanitizing benefit to the treated hard surfaces as they are easily rinsed away with water, and thus are not retained on the treated hard surface. It would be desirable to provide a hard surface cleaning and/or disinfecting composition which is effective in the removal of hard water stains and/or soap scum stains from hard surfaces, which also provides a long term cleaning or sanitizing benefit. While such a formulation would be desirable to the art, such is not easy to produce. While it is known that polymers and film forming materials can be utilized to give a hard surface a protective layer, (i.e., acrylates, urethanes and silanes,) such materials are usually not compatible with chelating agents, quaternary ammonium salts, or in non-neutral pH conditions (i.e., acidic) that are known to be advantageous for cleaning and disinfecting of hard surfaces.

Accordingly there is a real and continuing need in the art for improved hard surface treatment compositions which provide a cleaning or disinfecting benefit, (preferably both) and which form a film on the treated surface to provides a residual protective benefit.

It is therefore among the objects of the invention to provide an aqueous acidic hard surface treatment composition which provides a cleaning benefit (particularly useful against hard water stains or soap scum, desirably both) or a disinfecting benefit which also forms film or surface coating on the treated hard surfaces, but which most desirably provides both a cleaning and disinfecting benefit. This film or surface coating provides the benefit of water or stain repellency to the treated hard surface, or provides the benefit of residual disinfection to the treated hard surface, but preferably provides both benefits.

It is yet a further object of the invention to provide a readily pourable and readily pumpable cleaning composition which features the benefits described above.

It is a further object of the invention to provide a process for cleaning or sanitization of hard surfaces, which process comprises the steps of providing the composition as outlined above, and applying an effective amount to a hard surface.

These and other objects of the invention will be more apparent from a reading of the specification and of the claims attached.

According to a first aspect of the invention there is provided an aqueous, acidic hard surface cleaning composition which provides a cleaning benefit or disinfecting benefit (preferably both benefits) to a hard surface which comprises the following constituents:

(a) a film-forming, organosilicone quaternary ammonium compound;

(b) at least one zwitterionic surfactant compound which is compatible with the quaternary ammonium compound, preferably including at least one amine oxide compound;

(c) at least one nonionic surfactant;

(d) at least one organic solvent; and, (e) optionally, at least one amphoteric surfactant;

(f) water.

wherein the aqueous compositions are at an acidic pH, preferably are at a pH of 4 or less, (preferably at a pH of 3 or less, even more preferably at a pH of 2 or less) and wherein the aqueous compositions may be characterized as forming a film or surface coating which provides the benefit of water or stain repellency to the treated hard surface, or provides the benefit of residual disinfection to the treated hard surface, but preferably provides both benefits.

The compositions described above may include one or more further optional constituents including but not limited to further non-aqueous (organic) solvents, pH buffering agents, perfumes, perfume carriers, colorants, hydrotropes, germicides, thickeners, fungicides, anti-oxidants, anti-corrosion agents, etc.

Preferred compositions according to the invention are largely aqueous, comprising at least 80% wt. water, and are readily pourable and pumpable. The preferred compositions all exhibit good storage stability.

According to a second aspect of the invention, there is provided a process for cleaning or sanitization of hard surfaces, which process comprises the step of providing the composition as outlined above, and applying an effective amount to a hard surface requiring such treatment.

The compositions of the present invention provide excellent cleaning efficacy on hard water stains or soap scum on hard surfaces, as well as providing water repellency, and soap scum and hard water stain removal benefits. At the same time, the preferred compositions of the present invention also provide disinfecting efficacy to hard surfaces, while imparting a film or surface coating to the hard surface, which acts as a barrier to repel water and facilitate the reduction or prevention of further hard water stains or soap scum on said hard surfaces.

The acidic, aqueous compositions according to the invention comprise (a) a film-forming, organosilicone quaternary ammonium compound. Such compounds desirably also exhibit antimicrobial activity, especially on hard surfaces.

Specific examples of organosilicone quaternary ammonium salts that may be used in the compositions of this invention include organosilicone derivatives of the following ammonium salts: di-isobutylcresoxyethoxyethyl dimethyl benzyl ammonium chloride, di-isobutylphenoxyethoxyethyl dimethyl benzyl ammonium chloride, myristyl dimethylbenzyl ammonium chloride, myristyl picolinium chloride, N-ethyl morpholinium chloride, laurylisoquinolinium bromide, alkyl imidazolinium chloride, benzalkonium chloride, cetyl pyridinium chloride, coconut dimethyl benzyl ammonium chloride, stearyl dimethyl benzyl ammonium chloride, alkyl dimethyl benzyl ammonium chloride, alkyl diethyl benzyl ammonium chloride, alkyl dimethyl benzyl ammonium bromide, di-isobutyl phenoxyethoxyethyl trimethyl ammonium chloride, di-isobutylphenoxyethoxyethyl dimethyl alkyl ammonium chloride, methyl-dodecylbenzyl trimethyl ammonium chloride, cetyl trimethyl ammonium bromide, octadecyl dimethyl ethyl ammonium bromide, cetyl dimethyl ethyl ammonium bromide, octadec-9-enyl dimethyl ethyl ammonium bromide, dioctyl dimethyl ammonium chloride, dodecyl trimethyl ammonium chloride, octadecyl trimethyl ammonium chloride, octadecyl trimethyl ammonium bromide, hexadecyl trimethyl ammonium iodide, octyl trimethyl ammonium fluoride, and mixtures thereof. Other water dispersible salts, such as the acetates, sulfates, nitrates and phosphates, are effective in place of the halides, but the chlorides and bromides are preferred. The silicone group is preferably substituted with alkyl ethers. Preferred alkyl ethers are short carbon chain ethers such as methoxy and ethoxy substituents.

Examples of particularly preferred film-forming, organosilicone quaternary ammonium compounds which find use in the present inventive compositions include those which may be represented by the following structural representation:

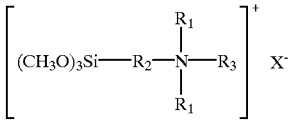

wherein:

$R_1$ and $R_2$ each independently represents short chain alkyl or alkenyl groups, preferably $C_1$–$C_8$ alkyl or alkenyl groups;

$R_3$ represents a $C_{11}$–$C_{22}$ alkyl group; and

X represents a salt forming counterion, especially a halogen.

Preferred short chain alkyl substituents for $R_1$ are methyl and ethyl. Preferred short chain alkyl substituents for $R_2$ are straight chain links of methylene groups consisting of from 1 to 4 members. Preferred $R_3$ substituents are straight chain links of methylene groups consisting of from 11 to 22 members, and preferred halogens for X are chloride and bromide. More preferably, both $R_1$ and $R_2$ are methyl.

A particularly preferred and commercially available film-forming, organosilicone quaternary ammonium compound useful in the inventive compositions is AEM® 5772 or AEM® 5700 (from Aegis Environmental Co., Midland, Mich.). Both of these materials are described as being 3-(trimethoxysilyl)propyloctadecyldimethylammonium chloride, AEM® 5700 and is sold as a 42% by weight active solution of the compound in a water/methanol mixture, while AEM® 5772 is sold as a 72% by weight active solution of the compound in a water/methanol mixture.

The film-forming, organosilicone quaternary ammonium compound are desirably present in the inventive compositions in amounts of from 0.01 to 1.0% by weight, preferably in amounts of from 0.05 to 0.9% wt., and most preferably from 0.1 to 0.7% by weight, based on the total weight of the aqueous composition of which it forms a part.

The compositions of the invention also contain (b) at least one zwitterionic surfactant compound, which is compatible with the (a) film-forming, organosilicone quaternary ammonium compound. This zwitterionic surfactant is most preferably an amine oxide compound. Useful amine oxides, may be defined as one or more of the following of the four general classes:

(1) Alkyl di (lower alkyl) amine oxides in which the alkyl group has about 6–24, and preferably 8–18, carbon atoms and can be straight or branched chain, saturated or unsaturated. The lower alkyl groups include from 1 to 7 carbon atoms, but preferably each include 1–3 carbon atoms. Examples include octyldimethylamine oxide, lauryldimethylamine oxide, myristyldimethylamine oxide, and those in which the alkyl group is a mixture of different amine oxides, such as dimethylcocoamineoxide, dimethyl(hydrogenated tallow)amine oxide, and myristyl/palmityldimethyl amine oxide;

(2) Alkyl di (hydroxy lower alkyl) amine oxides in which the alkyl group has about 6–22, and preferably 8–18, carbon atoms and can be straight or branched chain, saturated or unsaturated. Examples include bis-(2-hydroxyethyl)cocoamine oxide, bis-(2-hydroxyethyl) tallowamine oxide; and bis-(2-hydroxyethyl) stearylamine oxide;

(3) Alkylamidopropyl di(lower alkyl) amine oxides in which the alkyl group has about 10–20, and preferably 12–16, carbon atoms and can be straight or branched chain, saturated or unsaturated. Examples are cocoamidopropyldimethylamine oxide and tallowamidopropyldimethylamine oxide; and (4) Alkylmorpholine oxides in which the alkyl group has about 10–20, and preferably 12–16, carbon atoms and can be straight or branched chain, saturated or unsaturated.

The preferred amine oxides are those which may be represented by the structure:

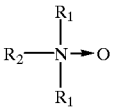

wherein each $R_1$ independently is a straight chained $C_1$–$C_4$ alkyl group, preferably both $R_1$ are methyl groups; and $R_2$ is a straight chained $C_6$–$C_{22}$ alkyl group, preferably a $C_6$–$C_{16}$ alkyl group, and most preferably is a $C_{8-10}$ alkyl group, especially a $C_8$ alkyl group;

Each of the alkyl groups may be linear or branched, but preferably are linear. Most preferably the amine oxide constituent is lauryldimethylamine oxide. Technical grade mixtures of two or more amine oxides may be used, wherein amine oxides of varying chain lengths of the $R_2$ group. Preferably, the amine oxides used in the present invention include $R_2$ groups which comprise at least 50% wt., preferably at least 75% wt., of $C_8$ alkyl group.

Exemplary and preferred amine oxide compounds include N-alkyldimethylamine oxides, particularly octyldimethylamine oxides as well as lauryldimethylamine oxide. These amine oxide compounds are available as surfactants from McIntyre Group Ltd. under the name Mackamine® C-8 which is described as a 40% by weight active solution of octyldimethylamine oxide, as well as from Stepan Co., under the trade name Ammonyx® LO which is described to be as a 30% wt. active solution of lauryldimethylamine oxide.

The compositions of the present invention contain from 0.05 to 5% by weight of the zwitterionic amine oxide compound. Desirably the amine oxide compound is present on amounts of from 0.1 to 2.5% wt., more desirably form from 0.5 to 2.0% wt. of the present inventive compositions.

The compositions of the present invention further include (c) a nonionic surfactant. Suitable nonionic surfactants include, inter alia, condensation products of alkylene oxide groups with an organic hydrophobic compound, such as an aliphatic compound or with an alkyl aromatic compound. The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent. Further, the length of the polyethenoxy hydrophobic and hydrophilic elements may be varied to adjust these properties.

One example of such a nonionic surfactant is the condensation product of one mole of an alkylphenol having an alkyl group containing from 6 to 12 carbon atoms with from about 5 to 25 moles of an alkylene oxide. Another example of such a nonionic surfactant is the condensation product of one mole of an aliphatic alcohol which may be a primary, secondary or tertiary alcohol having from 6 to 18 carbon atoms with from 1 to about 10 moles of alkylene oxide. Preferred alkylene oxides are ethylene oxides or propylene oxides or mixtures thereof.

Preferred nonionic surfactants include primary and secondary linear and branched alcohol ethoxylates, such as those based on $C_{10}$ to $C_{16}$ alcohols which further include an average of from 3 to 10 moles of ethoxylation per mol of alcohol Particularly preferred nonionic surfactants are $C_{11}$ linear primary alcohol ethoxylates averaging about 9 moles of ethylene oxide per mole of alcohol. These surfactants are available, for example, under the commercial name of Neodol 1–9, (from Shell Chemical Company, Houston, Tex.), or in the Genapol® series of linear alcohol ethoxylates, particularly Genapol® 26-L-60 or Genapol® 26-L-80 (from Clariant Corp., Charlotte, N.C.). A further class of nonionic surfactants which are advantageously present in the inventive compositions are those presently marketed under the Genapol® trade name. Particularly useful are those in the Genapol® "26-L" series which include for example: $C_{12-16}$ linear alcohols condensed with 1 mole of ethylene oxide (Genapol® 24-L-3); $C_{12-16}$ linear alcohols condensed with 1.6 moles of ethylene oxide (Genapol® 26-L-1.6); $C_{12-16}$ linear alcohols condensed with 2 moles of ethylene oxide (Genapol® 26-L-2); $C_{12-16}$ linear alcohols condensed with 3 moles of ethylene oxide (Genapol® 26-L-3); $C_{12-16}$ linear alcohols condensed with 5 moles of ethylene oxide (Genapol® 26-L-5); as well as $C_{12-16}$ linear alcohols condensed with varying amounts of ethylene oxide to provide specific cloud points of the surfactant (i.e., Genapol® 26-L-60, Genapol® 26-L-60N, and Genapol® 26-L-98These materials are commercially available Clariant Corp. (Charlotte, N.C.).

It is to be understood that nonionic surfactants other than those described above may also be used. By way of illustration, and not by way of limitation, examples include secondary $C_{12}$ to $C_{15}$ alcohol ethoxylates, including those which have from about 3 to about 10 moles of ethoxylation. Such are available in the Tergitol® series of nonionic surfactants (Union Carbide Corp., Danbury, Conn.), particularly those in the Tergitol® "15-S-" series. Further exemplary nonionic surfactants include linear primary $C_{11}$ to $C_{15}$ alcohol ethoxylates, including those which have from about 3 to about 10 moles of ethoxylation. Such are available in the Neodol® series of nonionic surfactants (Shell Chemical Co.)

The compositions of the invention contain from 0.05 to 1.5% by weight of a nonionic surfactant, based on the weight of the surfactant as a whole. Preferably, the compositions contain from 0.1 to 1.0% by weight of a nonionic surfactant. Most preferably, the compositions contain from 0.15 to 0.75% by weight of a nonionic surfactant, based on the weight of the compositions as a whole.

The compositions of the invention also comprise (d) an organic solvent constituent. Preferred organic solvents are those which show some solubility in water. Included among these are substituted hydrocarbons, especially those substituted with oxygen or nitrogen. Preferred classes of solvents with these characteristics are alcohols, amines, amides, esters and ethers.

Useful organic solvents are those which are at least partially water-miscible such as alcohols, water-miscible ethers (e.g. diethylene glycol diethylether, diethylene glycol dimethylether, propylene glycol dimethylether), water-miscible glycol ether (e.g. propylene glycol monomethylether, propylene glycol monoethylether, propylene glycol monopropylether, propylene glycol monobutylether, ethylene glycol monobutylether, dipropylene glycol monomethylether, diethyleneglycol monobutylether), lower esters of monoalkylethers of ethylene glycol or propylene glycol (e.g. propylene glycol monomethyl ether acetate) which are commercially available from various sources including: Union Carbide (Danbury, Conn.), Dow Chemical Co.(Midland, Mich.), and Eastman Chemical Co. (Kingsport, Tenn.). Mixtures of one or more of these organic solvents can also be used.

Preferred as solvents in this invention are the glycol ethers having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from 1 to 10 glycol monomer units. Preferred are glycol ethers having 1 to 5 glycol monomer units. These are $C_3$–$C_{20}$ glycol ethers. Examples of more preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenyl ether, and mixtures thereof. These materials include those available in the DOWANOL™ glycol ether series (Dow Chemical Co., Midland Mich.), or the CARBITOL™ series (Union Carbide Corp.) or the ARCOSOLV® series (ARCO Chemical Corp.). More preferably employed as the solvent is one or more solvents of the group consisting of: propylene glycol n-propyl ether, dipropylene glycol n-propyl ether, propylene glycol n-butyl ether, dipropylene glycol n-propyl ether, ethylene glycol n-butyl ether, diethylene glycol n-butyl ether, and mixtures thereof. Most preferably, the solvent is a diethylene glycol n-butyl ether [also recognized by the names 2-(2-butoxyethoxy)ethanol, butoxydiglycol and diethylene glycol monobutyl ether] having the formula: $C_4H_9OCH_2CH_2OCH_2CH_2OH$, and is available, for example, in the DOWANOL™ glycol ether series as DOWANOL DB diethylene glycol n-butyl ether.

The compositions of the invention contain from 0.1 to 10% by weight of the organic solvent, based on the total weight of the inventive compositions. Preferably, the organic solvent constituent is present from 1 to 8% by weight, more preferably from 2 to 7% by weight.

Optionally, but in certain cases desirably, the inventive compositions include (e) at least one amphoteric surfactant. By way of example, these include the salts of higher alkyl beta-amino propionic acids, e.g., sodium N-lauryl beta-alanine; the higher alkyl substituted betaines, such as lauryl dimethylammonium acetic acid; as well as amphoteric surfactants of the the imidazoline type exemplified by the disodium salt of 1-(2-hydroxyethyl)-1-(carboxymethyl)-2-(hendecyl)-4,5-dihydroimidazolinium hydroxide. An exemplary an preferred amphoteric surfactant is lauramidopropionic acid, which is commerically available in the DERIPHAT series (ex Henkel) or MACKAM series (ex McIntyre Group Inc.) of amphoteric surfactants. When present, they may comprise up to 5% wt. of the inventive compositions.

The compositions are largely aqueous in nature, and comprise as a further necessary constituent (f) water. Water is added to order to provide to 100% by weight of the compositions of the invention. The water may be tap water, but is preferably distilled and is more preferably deionized water. If the water is tap water, it is preferably substantially free of any undesirable impurities such as organics or inorganics, especially minerals salts which are present in hard water which may undesirably interfere with the operation of the constituents present in the aqueous compositions according to the invention.

As discussed previously, the inventive compositions may comprise one or more conventional optional additives. By way of non-limiting example, these include: pH adjusting agents and pH buffers including organic and inorganic salts; non-aqueous solvents; perfumes and perfume carriers; optical brighteners; coloring agents such as dyes and pigments; opacifying agents; hydrotropes; antifoaming agents; viscosity modifying agents such as thickeners; enzymes; anti-spotting agents; anti-oxidants; and anti-corrosion agents. These ingredients may be present in any combination and in any suitable amount that is sufficient for imparting the desired properties to the compositions, but it is to be understood that, in accordance with preferred embodiments of the invention, the inventive compositions are essentially free of conventional chelating agents. These one or more conventional optional additives, when present, should be present in minor amounts, preferably in total comprising less than about 5% by weight of the compositions, and desirably less than about 3% wt.

The compositions of the invention show improved efficacy at low pH values. Therefore it is desirable that the compositions of the invention have pH values that are acidic. The pH value of the aqueous composition is 4 or less, desirably is 3 or less, more desirably in the range of from 0.1 to 2, and particularly from 0.5–1.2. Such acidic pH values may be achieved by the use of one or more pH-adjusting constituents. Such acidic pH-adjusting constituents include for example, one or more organic acids (i.e., glycolic acid, sulfamic acid, citric acid or salts thereof). Preferably, the pH-adjusting constituents are chosen from glycolic acid, citric acid and mixtures of these two acids. The acidic pH-adjusting constituent is desirably present in the compositions of the invention from about 1 to 20% by weight, based on the weight of the composition as a whole. Preferably, the compositions contain from 3 to 15% by weight of an acidic pH-adjusting constituent. Most preferably, the compositions contain from 6 to 12% by weight of an acidic pH-adjusting agent, based on the weight of the pH-adjusting agent as a whole.

Such materials described herein are known to the art, including those described in *McCutcheon's Emulsifiers and Detergents* (*Vol.* 1), *McCutcheon's Functional Materials* (*Vol.* 2), North American Edition, 1991; *Kirk-Othmer, Encyclopedia of Chemical Technology,* 3rd Ed., Vol. 22, the contents of which are herein incorporated by reference For any particular composition, such optional ingredients should be compatible with the other ingredients present.

According to a particularly preferred embodiment of the invention there is provides an aqueous, acidic hard surface cleaning composition which provides a cleaning benefit or disinfecting benefit (preferably both benefits) to a hard surface which comprises, but preferably consists essentially of, the following constituents:

a) 0.01 to 1.0% wt. of a film-forming, organosilicone quaternary ammonium compound;

b) 0.05 to 5% wt. of at least one zwitterionic surfactant which is compatible with the quaternary ammonium compound;

c) 0.05 to 1.5% wt. of at least one nonionic surfactant;

d) 0.1 to 1 0% wt. of at least one organic solvent;

e) 0–5% wt. of at least one amphoteric surfactant, preferably a salt of a higher alkyl beta-amino propionic acid;

f) 80–100% wt. water; and, g) 0–5% wt. of one or more optional constituents;

wherein the aqueous compositions are at an acidic pH, preferably are at a pH of 4 or less, more preferably a pH of 3 or less, and wherein the aqueous compositions may be characterized as forming a film or surface coating which provides the benefit of water or stain repellency to the treated hard surface, or provides the benefit of residual disinfection to the treated hard surface, but preferably provides both benefits.

The aqueous compositions according to the invention are desirably provided as a ready to use product which may be directly applied to a hard surface. Hard surfaces which are to be particularly denoted are lavatory fixtures and lavatory appliances (toilets, bidets, shower stalls, bathtubs and bathing appliances), wall and flooring surfaces especially those which include refractory materials and the like. Further hard surfaces which are particularly denoted are those associated with kitchen environments and other environments associated with food preparation. Hard surfaces also include those associated with hospital environments, medical laboratories and medical treatment environments. Such hard surfaces described above are to be understood as being recited by way of illustration and not by way of limitation.

The aqueous compositions according to the invention are particularly useful in the treatment of hard surfaces wherein hard water stains or soap scum are prone to occur, particularly hard surfaces associated with lavatories including lavatory fixtures and appliances.

The composition provided according to the invention can be desirably provided as a ready to use product in a manually operated spray dispensing container.

The composition according to the invention is ideally suited for use in a consumer "spray and wipe" application. In such an application, the consumer generally applies an effective amount of the cleaning composition using a pump and within a few moments thereafter, wipes off the treated area with a rag, towel, or sponge, usually a disposable paper towel or sponge. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used. It is also to be understood that longer residence time of the inventive compositions on a hard surface may be required in order to attain greater degrees of cleaning, sanitization or disinfection. Where thorough disinfection is a primary consideration, it may be desired to apply the inventive compositions to the hard surface being treated and to permit the composition to remain on the hard surface for several minutes (2–10 min.) prior to rinsing or wiping the composition from the hard surface. It is also contemplated that the inventive compositions be applied to a hard surface without subsequently wiping or rinsing the treated hard surface.

Whereas the compositions of the present invention are intended to be used in the types of liquid forms described above, nothing in this specification shall be understood as to limit the use of said compositions with a further amount of water to form a cleaning solution. In such a proposed diluted cleaning solution, the greater the proportion of water added to form said cleaning dilution will, the greater may be the reduction of the rate and/or efficacy of the inventive compositions. Accordingly, longer residence times upon the surface and/or the usage of greater amounts may be necessitated. Conversely, nothing in the specification shall be also understood to limit the forming of a "super-concentrated" cleaning composition based upon the composition described above. Such super-concentrated ingredient compositions are essentially the same as the cleaning compositions described above except in that they include a lesser amount of water.

The following examples below illustrate exemplary and preferred formulations of the composition according to the instant invention. It is to be understood that these examples are presented by means of illustration only and that further useful formulations fall within the scope of this invention and the claims may be readily produced by one skilled in the art without deviating from the scope and spirit of the invention.

Throughout this specification and in the accompanying claims, weight percents of any constituent are to be understood as the weight percent of the active portion of the referenced constituent, unless otherwise indicated.

EXAMPLES

The following examples illustrate the formulation and performance of various compositions of the invention.

Exemplary formulations illustrating certain preferred embodiments of the inventive compositions and described in more detail in Table 1 below were formulated generally in accordance with the following protocol. The weight percentages indicated the "as supplied" weights of the named constituent.

Into a suitably sized vessel, a measured amount of water was provided after which the constituents were added in no specific or uniform sequence, thus indicating that the order of addition of the constituents was not critical. All of the constituents were supplied at room temperature, and any remaining amount of water was added thereafter. Certain of the nonionic surfactants if gels at room temperature were first preheated to render them pourable liquids prior to addition and mixing. Mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well mixed characteristics (i.e., stable mixtures) upon standing for extended periods. The compositions of the example formulations are listed on Table 1.

TABLE 1

| | Ex. 1 | Ex. 2 | Ex. 3 | Ex. 4 | Ex. 5 | Ex. 6 | Ex. 7 | Ex. 8 |
|---|---|---|---|---|---|---|---|---|
| AEM 5700 (42%) | 0.36 | 0.36 | 0.36 | 0.48 | 0.36 | 0.24 | 0.24 | 0.60 |
| Mackamine C-8 (40%) | 1.76 | 1.76 | 1.76 | 1.76 | 1.76 | 1.76 | 1.76 | 1.76 |
| Neodol 1-9 (100%) | 0.60 | 0.60 | 0.60 | 0.60 | 0.60 | 0.60 | 0.60 | 0.60 |
| Dowanol DB (100%) | 3.00 | 3.00 | 3.00 | 3.00 | 3.00 | 3.00 | 3.00 | 3.00 |
| EDTA Acid (100%) | — | — | — | — | — | — | — | — |
| sulfamic acid (99.5%) | — | 0.35 | 4.65 | 4.65 | 4.65 | 4.65 | 4.65 | 4.65 |
| glycolic acid (70%) | 3.57 | 5.60 | 5.60 | 5.60 | 5.60 | 5.60 | 5.60 | 5.60 |
| citric acid, anhydrous | 2.50 | — | — | — | — | — | — | — |
| fragrance | — | — | 0.35 | — | — | — | — | — |
| DI water | to 100 | to 100 | to 100 | to 100 | to 100 | to 100 | to 100 | to 100 |
| pH of formulation: | 2.26 | 2.00 | 0.77 | 0.63 | 0.72 | 0.69 | 0.87 | 0.81 |

The identity of the constituents of Table 1 above are described in more detail on Table 2, below, including the "actives" percentage of each.

TABLE 2

| Ingredient (% weight active) | |
|---|---|
| AEM 5700 (42%); | organosilicone quaternary ammonium compound from Aegis Chemical Co. |
| Mackamine C-8 (40%) | octyl amine oxide surfactant surfactant from McIntyre Group LTD |
| Neodol 1–9 (100%) | nonionic alcohol ethoxylate surfactant from Shell Chemical |
| Dowanol DB (100%) | diethylene glycol n-butyl ether from Eastman Chemical Co. |
| EDTA Acid (100%) | ethylenediaminetetraacetic acid |
| sulfamic acid (99.5%) | sulfamic acid from American International Chemical Co. |
| Glycolic acid (70%) | glycolic acid from Dupont Chemical Co. |
| Citric acid, anhydrous (100%) | anhyous citric acid |
| fragrance | proprietary composition |
| DI water | deionized water |

The formulations described on Table 1 were subjected to one or more of the following evaluations.

Cleaning Efficacy

The cleaning efficacy of each tested formulations were evaluated in order to determine their efficacy in removing stains, particularly in their efficacy in the removal of hard water stains, and removal of soap scum.

Hard Water Stain Cleaning Test

For the performance of this test the following materials were utilized.

As substrate samples: standard square glazed black ceramic tile, measuring 10.8 cm by 10.8 cm. As cleaning medium, a standard cellulose sponge. If the sponge were supplied with a surfactant or other entrained material, such were first removed by washing with warm water, either by hand or by machine, followed by complete drying of the sponge.

A standardized "hard water" soil was produced in the following manner: A first solution, "Solution A" was prepared as detailed below:

| Constituent | Weight % |
|---|---|
| Deionized water | 93.0% |
| Sodium Bicarbonate | 3.0% |
| Sodium metasilicate anhydrous | 4.0% |
| TOTAL | 100.0% |

First, the water was weighed into a suitably sized beaker equipped with a magnetic stir bar. While stirring, the sodium bicarbonate and sodium metasilicate were then added. The contents were allowed to stir until they were clear in appearance, which required generally from ½ to 1 hour.

A second solution, "Solution B" was also prepared as detailed below:

| Constituent | Weight % |
|---|---|
| Deionized water | 73.0% |
| Calcium chloride anhydrous | 2.0% |
| Magnesium chloride .6$H_2O$ | 1.0% |
| Ethanol 95% | 24.0% |
| TOTAL | 100.0% |

The water was first weighed into a suitably sized beaker equipped with a magnetic stir bar. While stirring, the ethanol, calcium chloride and magnesium chloride were added. The contents were allowed to stir until they were clear in appearance, which required generally from ½ to 1 hour.

The substrates (tiles) were prepared in the following manner: each tile was thoroughly washed (using a commercially available hand dishwashing detergent, Dove®) and scrubbed using a non-metallic scouring pad (such as a Chore Boy® Long Last scrubbing sponge). The washed tiles were then permitted to dry in an oven at 40.5° C. overnight, then withdrawn and allowed to cool to room temperature (approx. 20° C.) before being provided with the standardized "hard water" test soil. It is to be noted that for each test, new tiles were utilized, namely, the tiles were not reused.

Each of the prepared tiles were provided with the standardized "hard water" test soil in accordance with on of the following application protocols:

For a simulated "light" stain, 1.8 g of solution B and 2.6 g of solution A were premixed in a clean beaker and while mixing; 4.4 g of this mixture was pipetted and deposited onto the glazed surface of a tile. Subsequently a #8-side of a film applicator (P. G. & T. Co., Model #14) was drawn across the tile to form the deposited solution into a smooth uniform film. Any excess solution was removed at the end of the film-forming stroke.

Cleaning Evaluation

To evaluate cleaning, a treated test tile was placed in a Gardner Apparatus and secured. A dry 10 cm by 7.6 cm sponge was first moistened with 100 g of tap water, and the excess wrung out from the sponge. The sponge was then fitted into a suitably sized holder in the Gardner Apparatus. A 4–5 gram aliquot of a test formulation was then deposited directly onto the soiled surface of a tile, and allowed to contact the tile for 15 seconds. Thereafter, the Gardner Apparatus was cycled for from 3–6 strokes. The tile was then rinsed with tap water, and dried with compressed air from an airbrush compressor. This test was repeated several times for each formulation, using new treated test tile for each evaluation.

The tested tiles were evaluated by either reflective means, i.e., using a 60 degree angle reflectometer, (BYK-Gardner Co.) to measure the reflectance of the reference and treated tiles, or by objective means wherein a group of persons evaluated a set of tiles and provided an evaluation of the visual appearance of the tested tiles.

According to the reflective means, the percentage of hard water soil removal was determined utilizing the following equation:

$$\% \text{ Removal} = \frac{RC - RS}{RO - RS} \times 100$$

where

RC=Reflectance of tile after cleaning with test product

RO=Reflectance of original soiled tile

RS=Reflectance of soiled tile

For each tile, a number of readings were taken and the results averaged to provide a median reading for each tile.

According to the objective means, the soil removal was visually examined by a minimum of 20 independent judges, who evaluated each of a set of tested tiles. A clean substrate and soiled but untreated substrate are used as references. Soil removal was rated as follows:

| Rating: | Description of rating: |
|---|---|
| 0 | no soil removed, or minimal soil removed |
| 10 | approximately 10% soil removed |
| 20 | approximately 20% soil removed |
| 30 | approximately 30% soil removed |
| 40 | approximately 40% soil removed |
| 50 | approximately 50% soil removed |
| 60 | approximately 60% soil removed |
| 70 | approximately 70% soil removed |
| 80 | approximately 80% soil removed |
| 90 | approximately 90% soil removed |
| 100 | all soil removed |

The tested tiles were evaluated, and the results are indicated on the Table, below.

Soap Scum (Limescale) Cleaning Test

For the performance of this test the following materials were utilized. As substrate samples: standard square glazed black ceramic tile, measuring 10.8 cm by 10.8 cm. As cleaning medium, a standard cellulose sponge. If the sponge was supplied with a surfactant or other entrained material, such were first removed by washing with warm water, either by hand or by machine, followed by complete drying of the sponge. As a test shampoo, a simple moderate-cleaning type containing alkyl ethoxysulfates may be used. An exemplary shampoo composition is listed in the CSMA DCC-16 protocol.

This test is described generally as follows:

Soil Preparation

A "parent" soil is made, based on the following formulation:

| "Parent" soil | % w/w |
|---|---|
| bar soap | 3.90 |
| shampoo | 0.35 |
| clay | 0.06 |
| artificial sebum | 0.15 |
| hard water | 95.54 |

The parent soil was produced according to the following steps: First, the bar soap was shaved into a suitable beaker. Afterward the remaining constituents were added in the order given above and stirred with three-blade propeller mixer. Next, the contents of the beaker was heated to 45–50° C. and mixed until a smooth, lump-free suspension was achieved. This usually required about two hours with moderate agitation. Subsequently, the contents of the beaker were filtered through a Buchner funnel fitted with Whatman #1 filter paper or equivalent. The filtrate was then resuspended in clean, deionized water, using the same amount of water used to make the soil, and this was filtered again. The (re-filtered) filtrate was uniformly dried overnight at 45° C. to form a filter cake. Thereafter, the filter cake was pulverized and was suitable for immediate use, or may be stored in a sealed container for up to six months.

Substrate Preparation:

The test substrates (tiles) were prepared in the following manner: each tile was thoroughly washed (using a commercially available hand dishwashing detergent, Dove®) and scrubbed using a non-metallic scouring pad (such as a Chore Boy® Long Last scrubbing sponge). The washed tiles were then permitted to dry in an oven at 40.5° C. overnight, then withdrawn and allowed to cool to room temperature (approx. 20° C.) before being provided with the standardized "hard water" test soil. It is to be noted that for each test, new tiles were utilized, namely, the tiles were not reused.

In preparation for supplying the tiles with an amount of the test soil, a test soil was prepared based on the following formulation:

| Test soil: | % w/w |
|---|---|
| "parent" soil | 4.50 |
| hard water | 9.0 |
| hydrochloric acid (0.1N) | 0.77 |
| acetone | 85.73 |

The test soil was produced according to the following steps: The constituents indicated were introduced into a clean beaker, with the acetone being added prior to the water, and the 'parent' soil being added last. The contents of the beaker were mixed using a standard three blade laboratory mixer until the contents formed a uniform mixture, and the color changed from white to gray. This typically required 20–40 minutes, during which time the beaker was covered as much as possible to avoid excessive solvent loss. Next, a suitable quantity of the contents of the test soil from the beaker was provided to an artist's airbrush while the beaker was swirled to ensure a soil uniformity. (If testing required more than one day, a fresh amount of test soil was prepared daily and used for that day's testing.)

Soil was applied to a number of clean, dry tiles placed into rows and columns in preparation for depositing of the test soil. The airbrush was operated at 40 psi, and the test soil was sprayed to provide a visually uniform amount of soil onto the tiles. (Uniform soil suspension during application was maintained by continuous brush motion and/or swirling of test soil in the airbrush.) In this manner, approximately 0.10 g–0.15 g test soil were applied per tile.

The tiles were then allowed to air dry for approximately 30 minutes, during which time the a laboratory hotplate was preheated to approximately 320° C. Each tile was sequentially placed on the hotplate until the test soil began to melt, thereby "aging" the test soil. The melting of the test soil was observed carefully, and each tile was removed shortly before the soil began to coalesce into large droplets. This process was repeated for each tile, allowing the hotplate to recover to 320° C. between tiles. Subsequently each tile was permitted to cool for at least about 30 minutes.

Evaluation of the tested tiles was in accordance with the manner described previously.

The test results for cleaning of both limescale and hard water stains, which were determined by the "subjective" method, are as follows:

TABLE 3

| | Soap Scum (Limescale) | hard water stains |
|---|---|---|
| Ex. 1 | 80–90 | 90 |
| Ex. 2 | 80–90 | 90 |
| Ex. 3 | 80–90 | 90 |
| Ex. 4 | 80–90 | 90 |
| Ex. 5 | 80–90 | 90 |
| Ex. 6 | 80–90 | 90 |
| Ex. 7 | 80–90 | 90 |
| Ex. 8 | 80–90 | 90 |

These results indicate that the tested formulations provided excellent performance.

Surface Protection

The surface repellency of treated tiles was evaluated by determining the contact angle of water on treated tile. The contact angle was determined utilizing a Kruss Goniometer, and the results were evaluated using a computer program titled "Contact Angle Measurement System G40 v.1.32-US (commercially available from Hewlett Packard Co.). On a test substrate, four readings were taken of the contact angles of a droplet of water and the average of these four readings indicated an angle of 75 degrees. This is indicative of the presence of a hydrophobic film on the surface of the treated tile.

Evaluation of Antimicrobial Efficacy

Formulation described in Table 1 above were evaluated in order to evaluate their antimicrobial efficacy against *Staphylococcus aureus* (Gram positive type pathogenic bacteria) (ATCC 6538), *Salmonella choleraesuis* (Gram negative type pathogenic bacteria) (ATCC 10708), and *Pseudomonas aeruginosa* (ATCC 15442). The testing was performed in accordance with the protocol of the Association of Official Analytical Chemists; "Germicidal Spray Test".

As is appreciated by the skilled practitioner in the art, the results of the AOAC Germicidal Spray Test indicates the number of test substrates wherein the tested organism remains viable after contact for 10 minutes with a test disinfecting composition/total number of tested substrates (cylinders) evaluated in accordance with the AOAC Germicidal Spray Test. Thus, a result of "0/30" indicates that, of 60 test substrates bearing the test organism and contacted for 10 minutes in a test disinfecting composition, 0 test substrates had viable (live) test organisms at the conclusion of the test. Such a result is excellent, illustrating the excellent disinfecting efficacy of the tested composition.

Results of the antimicrobial testing are indicated on Table 4, below. The reported results indicate the number of test cylinders with live test organisms/number of test cylinders tested for each example formulation and organism tested.

TABLE 4

| | Antimicrobial Efficacy | | |
|---|---|---|---|
| Example Formulation | *Staphylococcus aureus* | *Salmonella choleraesuis* | *Pseudomonas aeruginosa* |
| Ex. 2 | 0/30 | 0/30 | 0/30 |
| Ex. 3 | 0/30 | 0/30 | 0/30 |

As may be seen from the results indicated above, the compositions according to the invention provide excellent cleaning benefits to hard surfaces, including hard surfaces with difficult to remove stains yet at the same time they are surprisingly mild to skin and the mucous tissues of the user which is uncharacteristic of cleaning compositions which include any significant proportion of alkaline constituent. These advantages are further supplemented by the excellent antimicrobial efficacy of these compositions against known bacteria commonly found in bathroom, kitchen and other environments.

It is to be understood that, while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An aqueous, acidic hard surface cleaning composition which provides a cleaning benefit and/or disinfecting benefit to a hard surface, said composition consisting of:

(a) a film forming, organosilicone quaternary ammonium compound;

(b) at least one amine oxide surfactant;

(c) at least one nonionic surfactant;

(d) at least one glycol ether solvent;

(e) optionally, at least one amphoteric surfactant;

(f) water; and (g) optionally, at least one additive selected from pH adjusting agents, pH buffers, perfumes and perfume carriers, optical brighteners, coloring agents, opacifying agents, antifoaming agents, thickeners, anti-spotting agents, anti-oxidants and anti-corrosion agents wherein the aqueous composition is at an acidic pH and wherein the aqueous composition is characterized as forming a film or surface coating which provides the benefit of water or stain repellency to a hard surface treated therewith.

2. A composition according to claim 1 wherein the total amount of additivies does not exceed 5% wt. of the composition.

3. A composition according to claim 1 comprising from 1 to 20% by weight of at least one acidic pH-adjusting agent.

4. A composition according to claim 3 wherein the pH-adjusting agent comprises at least one compound selected from the group consisting of sulfamic acid, glycolic acid and citric acid.

5. A composition according to claim 1 wherein the organosilicone quaternary ammonium compound is a compound according to the following formula:

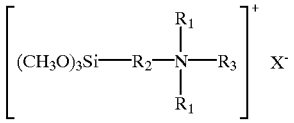

wherein $R_1$ and $R_2$ are $C_1$–$C_8$ alkyl, $R_3$ is $C_{11}$ to $C_{22}$ alkyl, and X is a halogen.

6. A composition according too claim 5 wherein the amine oxide surfactant is a $C_6$–$C_{12}$ amine oxide.

7. A composition according to claim 6 wherein the amine oxide surfactant is a $C_8$ amine oxide.

8. A composition according to claim 5 wherein the nonionic surfactant is an alcohol ethoxylate.

9. A composition according to claim 1 wherein the nonionic surfactant is an alcohol ethoxylate.

10. A composition according to claim 1 which comprises up to 5% wt. of an amphoteric surfactant.

11. A composition according to claim 1 wherein the pH is between 0.1 and 4.0.

12. A composition according to claim 1 consisting of:

(a) 0.01 to 1.0% wt. of a film forming, organosilicone quarternary ammonium compound;

(b) 0.05 to 5% wt. of at least one amine oxide surfactant;

(c) 0.05 to 1.5% wt. of at least one nonionic surfactant;

(d) 0.1 to 10% wt. of at least one glycol ether solvent;

(e) 0 to 5% wt. of at least one amphoteric surfactant; and (f) sufficient water to attain 100% wt.

13. A composition according to claim 12 wherein: the organosilicone quaternary ammonium compound is 3-(trimethoxysilyl)-propyloctadecyldimethyl ammonium chloride; the amine oxide surfactant is N-octyldimethylamine oxide; the nonionic surfactant is a $C_{11}$ linear primary alcohol ethoxylate; and the solvent is diethylene glycol n-butyl ether.

* * * * *